US005769063A

United States Patent [19]

Mizusawa

[11] Patent Number: 5,769,063

[45] Date of Patent: Jun. 23, 1998

[54] MALFUNCTION DETECTING APPARATUS FOR AIR-FUEL RATIO SENSOR

[75] Inventor: Kazuya Mizusawa, Toyota, Japan

[73] Assignee: Toyota Jidosha Kabushiki Kaisha, Toyota, Japan

[21] Appl. No.: 867,447

[22] Filed: Jun. 2, 1997

[30] Foreign Application Priority Data

Jun. 5, 1996 [JP] Japan ..... 8-142780

[51] Int. Cl.[6] ..... F02D 41/14; F02D 41/22

[52] U.S. Cl. ..... 123/688; 73/118.1; 204/401

[58] Field of Search ..... 123/479, 688, 123/690; 73/118.1; 204/401, 406, 425

[56] References Cited

U.S. PATENT DOCUMENTS 4,777,922 10/1988 Mieno et al. ..... 123/688

4,886,028 12/1989 Uchinami et al. ..... 123/688

*Primary Examiner*—Tony M. Argenbright

*Attorney, Agent, or Firm*—Oliff & Berridge, PLC

[57] ABSTRACT

A malfunction detecting apparatus detects malfunctions in an air-fuel ratio sensor employed in an internal combustion engine. The air-fuel ratio sensor is located in an exhaust passage. The output current value of the sensor varies in accordance with an applied voltage and the concentration of oxygen in the exhaust gas. An electronic control unit controls the amount of fuel in the mixture in accordance with the magnitude of the output current of the sensor such that the air-fuel ratio of the mixture is made to coincide with a target air-fuel ratio. The sensor has an applied voltage range in which the output current value remains substantially zero when the air-fuel ratio of the mixture matches a theoretical optimum air-fuel ratio. A voltage changer changes the applied voltage to a voltage located outside of the certain applied voltage range, and the electronic control unit detects malfunctions in the sensor after the applied voltage is changed by comparing the output current of the sensor with a reference value.

12 Claims, 4 Drawing Sheets

MALFUNCTION DETECTING APPARATUS FOR AIR-FUEL RATIO SENSOR

BACKGROUND OF THE INVENTION

1. Field of the Invention

The present invention relates to an apparatus for detecting malfunctions in air-fuel ratio sensors that detect air-fuel ratio of air-fuel mixture in internal combustion engines.

2. Description of the Related Art

In internal combustion engines, air-fuel mixture is combusted in combustion chambers and the resulting exhaust gas is discharged to the outside through an exhaust passage. An air-fuel ratio sensor is located in the exhaust passage for detecting the concentration of oxygen in the exhaust gas. The air-fuel ratio of the air-fuel mixture is computed based on the detected oxygen concentration. The computed air-fuel ratio is then compared with a predetermined air-fuel ratio (usually a theoretical optimum air-fuel ratio). The amount of fuel in the mixture is feedback controlled such that the detected ratio becomes equal to the predetermined ratio.

Recently, air-fuel ratio sensors of a so-called limit current type have been used. FIG. 6 is a graph showing the relationship between the value of voltage applied to such a sensor and the value of current outputted from the sensor. The continuous line represents the relationship between voltage and current for the predetermined air-fuel ratio. The alternate long and short dash line represents the relationship between voltage and current when the air-fuel ratio is rich. The two-dot chain line represents the relationship between voltage and current when the air-fuel ratio is lean.

As shown in the graph of FIG. 6, there is a region where the values of current remain constant (herein after referred to as "limit current value") for any given value of applied voltage. When the applied voltage is outside of the region, the value of the current changes substantially in relation to the value of applied voltage.

The limit current value is greater as the air-fuel ratio becomes leaner. In order to detect the air-fuel ratio, a predetermined voltage V, which is in the limit current value region, is applied to the sensor. Then, the corresponding limit current value is measured for determining the air-fuel ratio.

In an internal combustion engine, the amount of fuel supplied thereto is controlled based on the air-fuel ratio detected by the air-fuel sensor. It is therefore necessary to accurately detect malfunctions such as breakage of the sensor or the sensor circuit.

However, in the above described limit current type air-fuel ratio sensor, the limit current value is zero as shown in FIG. 6 when the detected air-fuel ratio matches the predetermined air-full ratio. Therefore, when the limit current becomes zero because of a breakage or a rupture, it is extremely difficult to judge whether the zero current is the result of a malfunction or the detected fuel ratio matching the predetermined fuel ratio.

SUMMARY OF THE INVENTION

Accordingly, it is an objective of the present invention to provide a malfunction detecting apparatus for accurately detecting malfunctions of an air-fuel ratio sensors having a region of applied voltage in which the output current value is zero when the detected air-fuel ratio matches a predetermined air-fuel ratio.

To achieve the foregoing and other objectives and in accordance with the purpose of the present invention, a malfunction detecting apparatus for an air-fuel ratio sensor employed in an internal combustion engine is provided. The engine includes an intake passage for introducing air-fuel mixture to a combustion chamber and an exhaust passage for exhausting exhaust gas generated by combustion of the air-fuel mixture in the combustion chamber. The air-fuel ratio sensor is located in the exhaust passage. The current value of the sensor, when energized, varies in accordance with the applied voltage and the concentration of oxygen in the exhaust gas. The engine also includes a controller for controlling the amount of the fuel in the mixture in accordance with the magnitude of the current value when a predetermined voltage is applied to the sensor such that the air-fuel ratio of the mixture becomes equal to a target air-fuel ratio The sensor has an applied voltage region in which the current value remains substantially zero when the air-fuel ratio of the mixture matches a predetermined theoretical air-fuel ratio. The malfunction detecting apparatus further includes a determiner, a voltage changer, and a malfunction detector. The determiner determines that the amount of the fuel in the mixture is being controlled such that the air-fuel ratio matches the predetermined theoretical air-fuel ratio. The voltage changer changes the predetermined voltage to a voltage located outside of the applied voltage region when the determiner determines that the amount of fuel in the mixture is being controlled such that the air-fuel ratio matches the predetermined theoretical air-fuel ratio. The malfunction detector detects malfunctions in the sensor after the predetermined voltage is changed to the voltage located outside of the applied voltage region.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to tho drawing.

Figure 1:
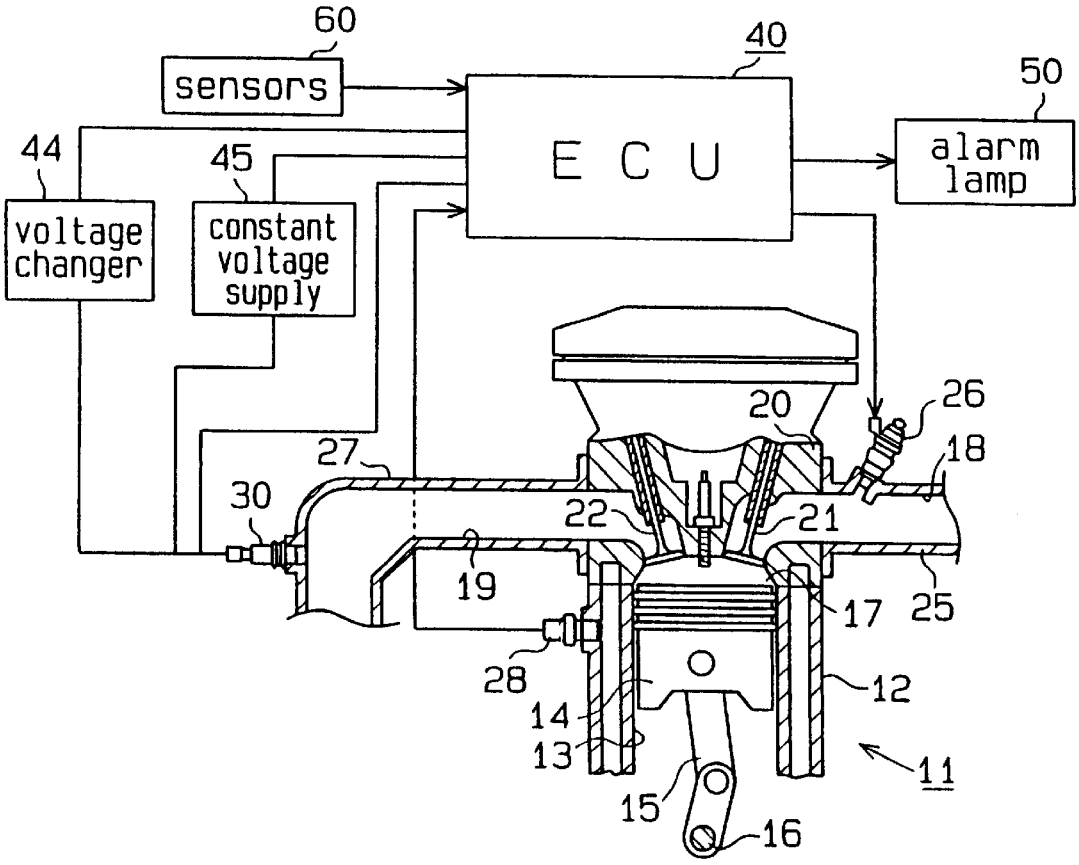
FIG. 1 is a partially cross-sectional view diagrammatically illustrating the structure of an engine system having a malfunction detecting system for an air-fuel ratio sensor according to a first embodiment of the present invention.

FIG. 1 schematically shows a part of a gasoline engine 11. The engine 11 includes a cylinder block 12 and a cylinder head 20. A plurality of cylinders 13 (only one is shown) are defined in the cylinder block 12. A piston 14 is reciprocally housed in each cylinder 13. Each piston 14 is connected to a crankshaft 16 by a connecting rod 15. Reciprocation of the pistons 14 is converted into rotational motion of the crankshaft 16 by the cooperation of the connecting rods 15 and the crankshaft 16.

A combustion chamber 17 is defined in the upper portion of each cylinder 13 by the piston 14 and the inner wall of the cylinder 13. An intake passage 18 and an exhaust passage 19 are connected to each combustion chamber 17. The cylinder block 20 is provided with a plurality of intake valves 21 and a plurality of exhaust valves 22. Each intake valve 21 and each exhaust valve 22 correspond to one of the cylinders 13. The intake valves 21 selectively communicate and disconnect the combustion chambers 17 with the intake passage 18. Similarly, the exhaust valves 22 selectively communicate and disconnect the combustion chambers 17 with the exhaust passage 19.

The intake passage 18 includes an air cleaner (not shown), a surge tank (not shown) and an intake manifold 25 in that order from the upstream end to the combustion chambers 17. The outside air is introduced to the combustion chambers 17 through these components.

The intake manifold 25 is provided with a plurality of fuel injection valves 26, each corresponding to one of the cylinders 13. Fuel injected from the valves 26 is mixed with air flowing in the Intake passage 18. The resulting air-fuel mixture is drawn into each combustion chamber 17.

The exhaust passage 19 includes an exhaust manifold 27 and a catalytic converter (not shown) in that order from the combustion chambers 17 to the downstream end. Exhaust gas is exhausted to the outside of the engine 11 through these components.

A cylinder block 12 is provided with a coolant temperature sensor 28 that detects the temperature THW of the engine coolant. A limit current type air-fuel ratio sensor (oxygen sensor) 30 is located in the exhaust passage 19. The sensor 30 detects the concentration of oxygen in the exhaust gas. The oxygen concentration in the exhaust gas corresponds to the air-fuel ratio of the air-fuel mixture drawn into the combustion chambers 17.

Figure 2:
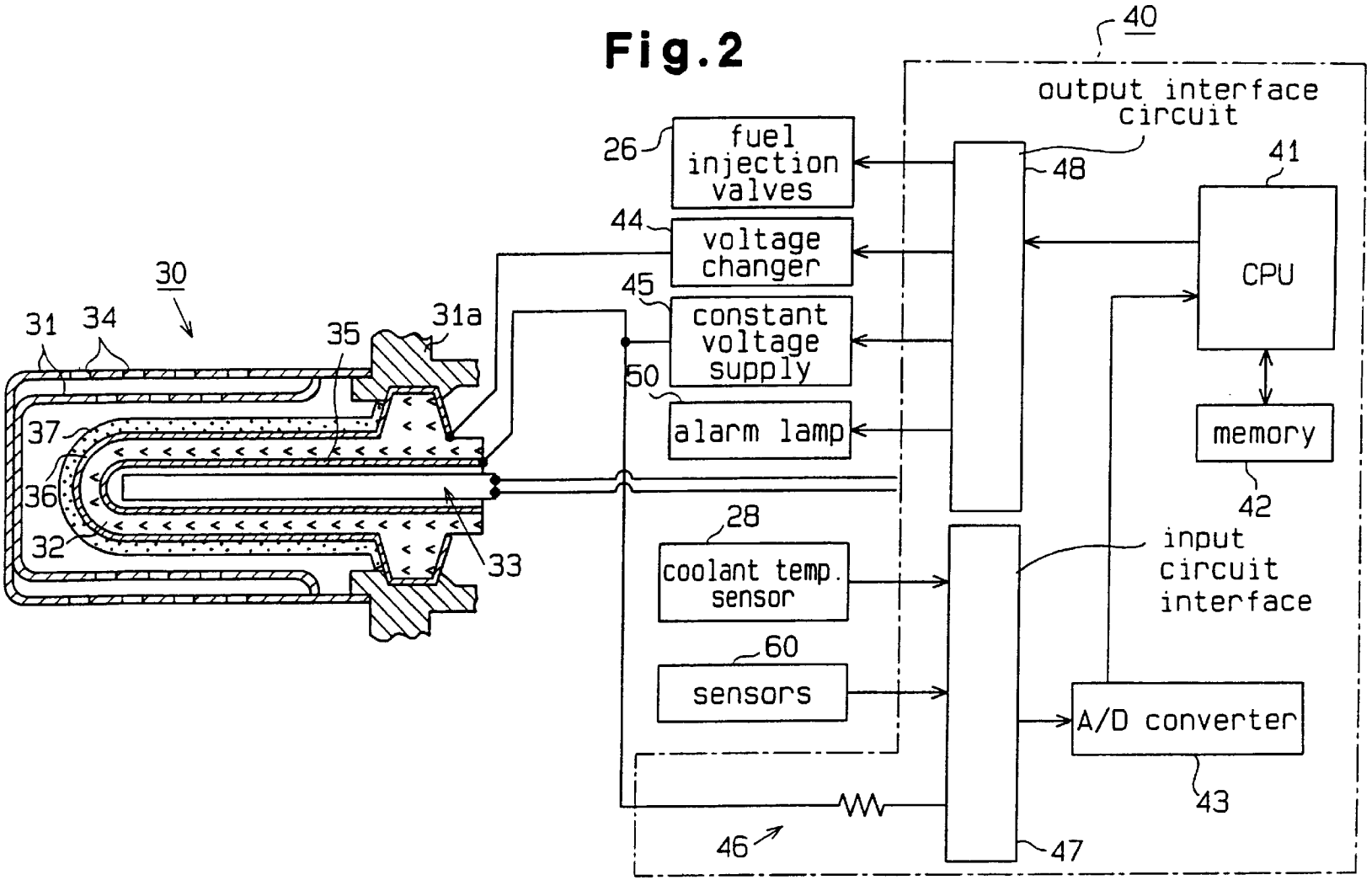
FIG. 2 is a cross-sectional view and a block diagram view illustrating an air-fuel ratio sensor and the structure of an electronic control unit.

The left side of FIG. 2 illustrates the construction of the air-fuel ratio sensor 30. The sensor 30 includes a double-pipe cover 31, a cylindrical element 32 located in the cover 31 and a heater 33 located in the element 32. The heater 33 warms the element 32 so that it is heated more rapidly.

A flange 31*a* is secured to an open end of the cover 31. The sensor 30 is located in the exhaust passage 19 by securing the flange 31*a* to the wall of the passage 19. This allows the distal end (left end as viewed in FIG. 2) of the sensor 30 to protrude from the wall of the passage 19. A plurality of holes 34 are formed in the cover 31 for allowing the exhaust gas in the passage 19 to flow into the cover 31.

The element 32 is provided with an inner platinum electrode 35 and an outer platinum electrode 36 formed on the inner wall and on the outer wall, respectively. A resistive layer 37 is formed on the outer electrode 36 for controlling the diffusion rate of oxygen flow about the element 32.

Exposing the resistive layer 37 to exhaust gas containing oxygen generates current between the electrodes 35 and 36. The value of the current is a function of the concentration of the oxygen in the exhaust gas and the value of voltage applied to the electrodes 35 and 36.

Figure 3:
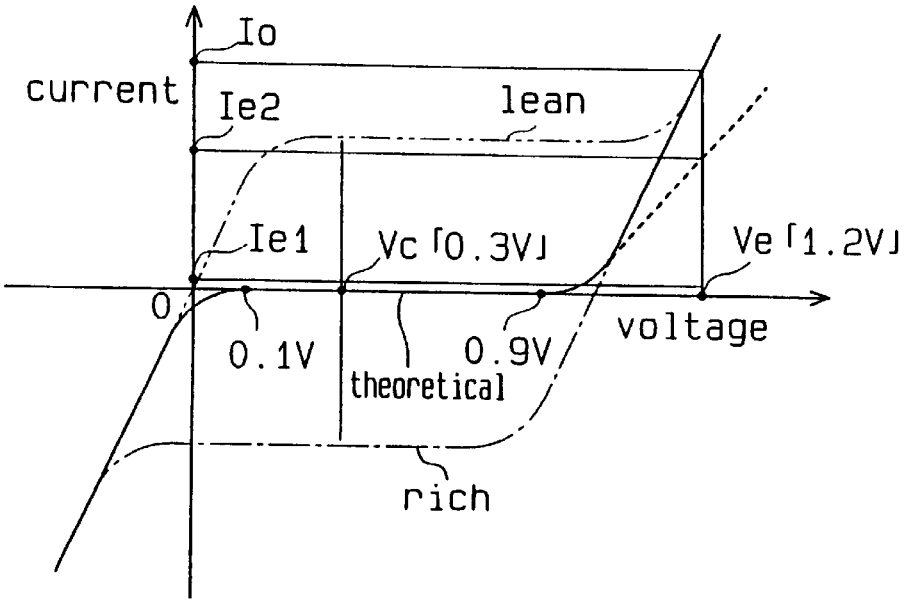
FIG. 3 is a graph showing the relationship between voltage applied to an air-fuel ratio sensor and value of the current output from the sensor.

FIG. 3 is a graph showing the relationship between the voltage applied to the electrodes 35 and 36, and the current between the electrodes 35 and 36. The continuous line represents a predetermined theoretical optimum air-fuel relationship. The alternate long and short dash line represents the relationship when the air-fuel ratio is rich. The two-dot chain line represents the relationship when the air-fuel ratio is lean.

As shown in FIG. 3, there is a region of voltage in the graph, where the current remains constant for any air-fuel ratio, that is, optimal, rich or lean. This region is hereinafter referred to as the limit applied voltage region. When the voltage applied to the sensor 30 is greater than the highest voltage (upper limit voltage) in the limit applied voltage region, the current value increases substantially in relation to the applied voltage. On the other hand, when the voltage applied to the sensor 30 is lower than the lowest voltage (lower limit voltage) in the limit voltage region, the current value decreases substantially in relation to the applied voltage.

For example, when the air-fuel ratio is optimal, the limit voltage region lies between 0.1V to 0.9V, and the limit current value is substantially 0 mA. In this case, the upper limit voltage is 0.9 volt and the lower limit voltage is 0.1 volt.

The limit current value increases as the air-fuel ratio increases, or the air-fuel mixture becomes leaner. In other words, the limit current value changes in accordance with the air-fuel ratio. These characteristics of the limit current are used for detecting the air-fuel ratio of the intake air.

The engine 11 is provided with an electronic control unit (ECU) 40. The ECU 40 controls the fuel injection valves 26 based on detection signals from the coolant temperature sensor 28, the air-fuel ratio sensor 30 and other sensors 60. Tho ECU 40 also detects malfunctions of the air-fuel sensor 30.

As shown in FIG. 2, the ECU 40 includes a central processing unit (CPU) 41, a memory 42, an analog-to-digital converter 43, a current-sensing resistor 46, an input interface circuit 47 and an output interface circuit 48. The memory 42 previously stores a program for controlling the air-fuel ratio, a program for performing a malfunction detecting routine, and initial data. The CPU 41 performs various operations in accordance with the programs stored in the memory 42.

The CPU 41 is connected to the output interface circuit 48. Also connected to the circuit 48 are the fuel injection valves 26, a voltage changer 44, a constant voltage supply 45, the heater 33 and an alarm lamp 50. The alarm lamp 50 is lit when a malfunction in the air-fuel ratio sensor 30 is detected, thereby notifying the driver of the malfunction.

The CPU 41 controls the voltage changer 44 to change the voltage between the electrodes 35, 36. Specifically the CPU 41 changes the applied voltage between a first voltage Vc and a second voltage Ve. The first voltage Vc is applied to the electrodes 35, 36 for detecting the air-fuel ratio, and the second voltage Ve is applied for detecting malfunctions in the sensor 30.

The first voltage Vc and the second voltage Ve have predetermined values as shown in FIG. 3. The first voltage Vc is set to 0.3V, which is in the limit voltage region even if the air-fuel mixture is lean or rich as seen in FIG. 3. The second voltage Ve is set at 1.2V, which is greater than the upper limit voltage even if the air-fuel mixture is lean or rich as seen in FIG. 3.

The input interface circuit 47 is connected to the CPU 41 with the analog-to-digital converter 43 located in between. Also connected to the input interface circuit 47 are the current-sensing resistor 46, the coolant temperature sensor 28 and other sensors 60 for detecting the running state of the engine 11. The sensors 60 include a rotational speed sensor, an intake air temperature sensor and an intake air pressure sensor. The CPU 41 detects the current value between the electrodes 35 and 36 based on the current in the current-sensing resistor 46 and computes the air-fuel ratio of the intake air based on the detected current value between the electrodes 35 and 36.

Figure 4:
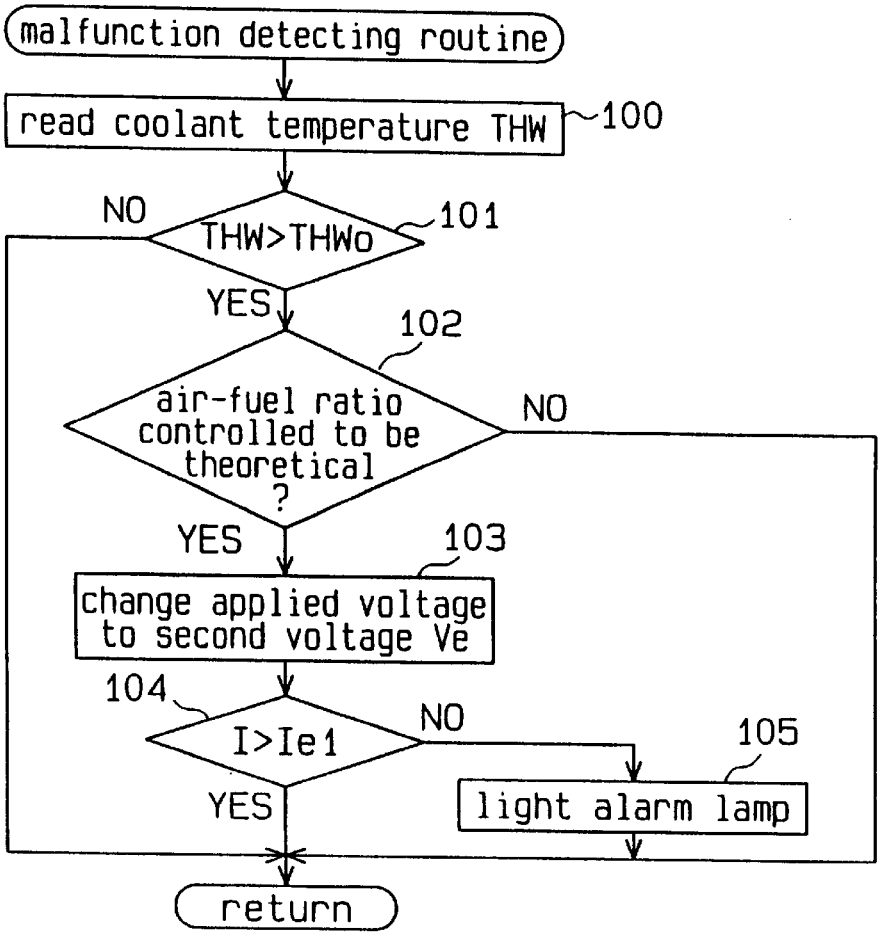
FIG. 4 is a flowchart showing a malfunction detecting routine according to a first embodiment of the present invention.

Next, the malfunction detecting routine for detecting malfunctions in the air-fuel ratio sensor 30 will be described. FIG. 4 is a flowchart of the routine. The CPU 41 periodically performs this routine at predetermined intervals. Upon starting of the engine 11, the voltage between the electrodes 35 and 36 is set to the first voltage Vc in another routine for controlling the air-fuel ratio.

In step 100, the CPU 41 reads the coolant temperature THW from the coolant temperature sensor 28.

In step 101, the CPU 41 judges whether the temperature THW is greater than a reference temperature $THWO_0$. If the determination condition is satisfied ($THW>THW_0$), the warm-up of the engine 11 is completed and a fuel increasing operation for the warm-up is not performed. Therefore, a sufficient length of time has elapsed since the starting of the engine. The element 32 of the sensor 30 Is therefore sufficiently warmed by the heat of exhaust gas and the heter 33 and is activated. The CPU 41 thus moves to step 102.

If the determination condition is not satisfied in step 101 ($THW \leqq THW_0$), the CPU 41 temporarily suspends the current routine and restarts this routine after the predetermined interval.

In step 102, the CPU 41 judges whether the air-fuel ratio is being controlled to matches the predetermined theoretical optimum air-fuel ratio. For example, in a routine designed for computing the amount of fuel injection, the CPU 41 feedback controls the air-fuel ratio based on the signal from the air-fuel ratio sensor 30. If the CPU 41 is controlling the ratio to be optimal, the CPU 41 sets a determination flag to a predetermined value. The CPU 41 judges whether the flag is set to the predetermined value in step 102, thereby judging whether the air-fuel ratio is being controlled to be optimal.

If the determination condition is not satisfied in step 102, the CPU 41 temporarily suspends the current routine.

If the determination condition is satisfied in step 102, the CPU 41 moves to step 103. In step 103, the CPU 41 controls the voltage changer 44 for switching the voltage between the electrodes 35 and 36 in the sensor 30 from the first voltage Vc to the second voltage Ve.

In step 104, the CPU 41 computes the current value I between the electrodes 35 and 36 and then judges whether the value I is greater than a first current value Ie1 ,stored in the memory 42.

The first current value Ie1 ,is employed for judging whether there is a malfunction such as breakage in the electrodes 35, 36 or breakage of the signal wires connecting the sensor 30 with the voltage changer 44 and with the constant voltage supply 45. The determination current value Ie1 ,may be set to 0 mA. However, in this embodiment, Ie1 ,is set to 3 mA for preventing tho effect of electrical noise.

If the determination condition is not satisfied in step 104, that is, if the current value I between the electrodes 35, 36 is equal to or smaller than the first current value Ie1, the CPU 41 determines that there is a malfunction in the air-fuel ratio sensor 30 and moves to step 105.

In step 105, the CPU 41 lights the alarm lamp 50, thereby notifying the passengers of the malfunction in the sensor 30. The CPU 41 also sets a malfunction determination flag to a state indicating that there is a malfunction in the sensor 30.

If the determination condition is satisfied in step 104 (I>Ie), or the process of step 105 is finished, the CPU 41 temporarily suspends the current routine and restarts this routine after a predetermined interval.

The operation and advantages will now be explained.

If the CPU 41 judges that the air-fuel ratio of the engine 11 is being controlled to be optimal in step 120, the CPU 41 changes the voltage between the electrodes 35 and 36 from the first voltage Vc to the second voltage Ve. As a result, the voltage between the electrodes 35 and 36 becomes greater than the upper limit of the limit voltage region.

If there is no malfunction in the sensor 30, the current I between the electrodes 35 and 36 increases to a certain current value $I_0$ ($I_0 >$Ie1). On the other hand, if there is a malfunction in the sensor 30, the current value becomes zero, which is less than Ie1. The current value I has different values depending on whether the air-fuel ratio sensor 30 is normally operating or there is a malfunction in the sensor 30. This allows malfunctions in the sensor 30 to be detected by comparing the current value I with the first determination current value Ie1.

The second voltage Ve is 1.2 V, which is positive and greater than the upper limit voltage in the limit voltage region. It is possible to employ a negative voltage (for example −0.5V), which is lower than the lower limit voltage in the limit voltage region, as the second voltage Ve. However, generating a voltage that is negative with respect to a base voltage (0V ) requires an inverter for lowering the base voltage to the target negative voltage. This complicates the construction of the circuit.

In this embodiment, the second voltage Ve has a positive value. This simplifies the circuit for detecting malfunctions in the air-fuel ratio sensor 30.

In order to stabilize the current value transmitted from the sensor 30, the temperature of the element 32 must be elevated to a predetermined temperature to be activated. For example, immediately after the engine 11 is started, the temperature of the element 32 is low and the element 32 is not activated. In this state, the relationship between the applied voltage and the outputted current illustrated in FIG. 3 is not obtained.

In this embodiment, the coolant temperature TRW is compared with a reference temperature $THW_0$. If THW is equal to or lower than $THW_0$, detection of malfunction in the sensor 30 is not performed. Therefore, the malfunction detection is started after a certain length of time has elapsed after the engine 11 is started. At this time, the element 32 is warmed by the heat of the exhaust gas and therefore activated. This prevents the sensor 30 from wrongly detecting malfunction in the sensor 30.

A second embodiment of the present invention will hereafter be described. The second embodiment is different from the first embodiment in the content of the processes of the malfunction detecting routine.

Figure 5:
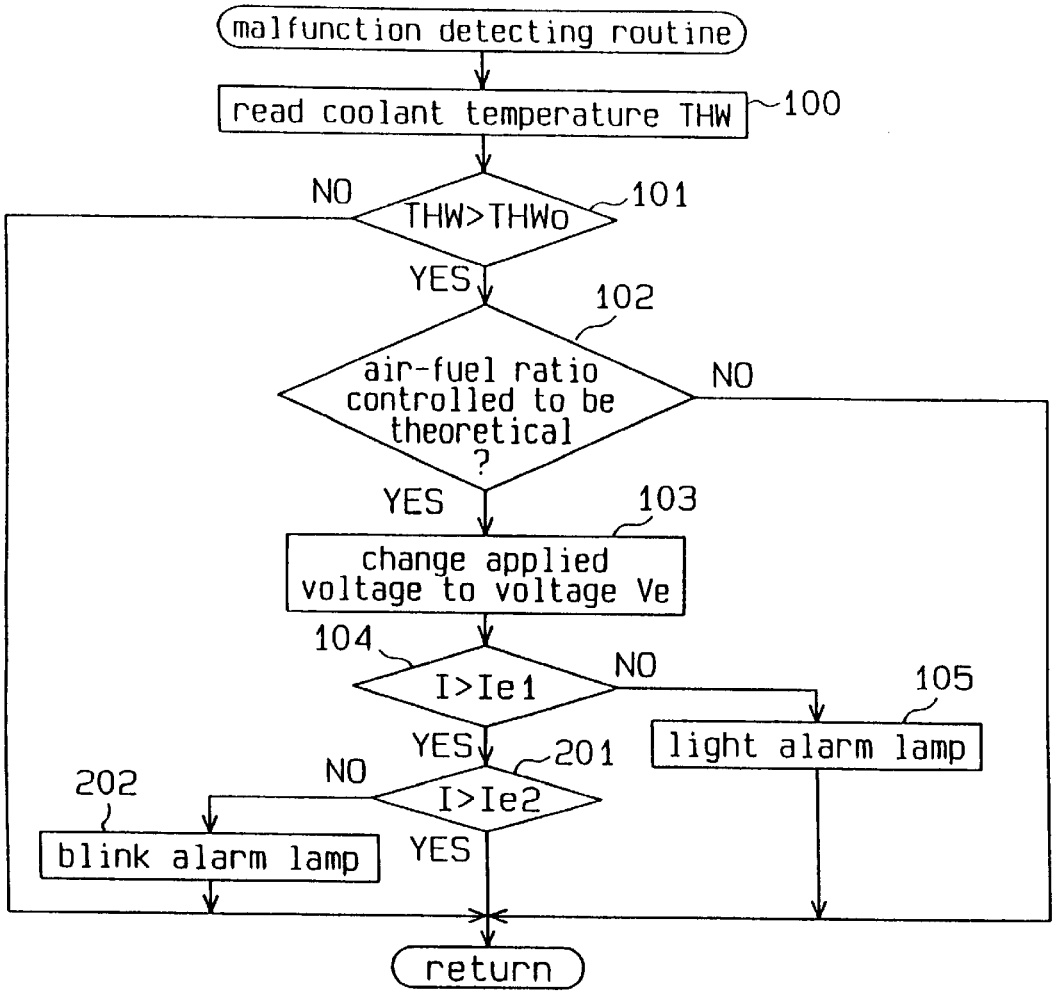
FIG. 5 is a flowchart showing a malfunction detecting routine according to a second embodiment of the present invention.
Figure 6:
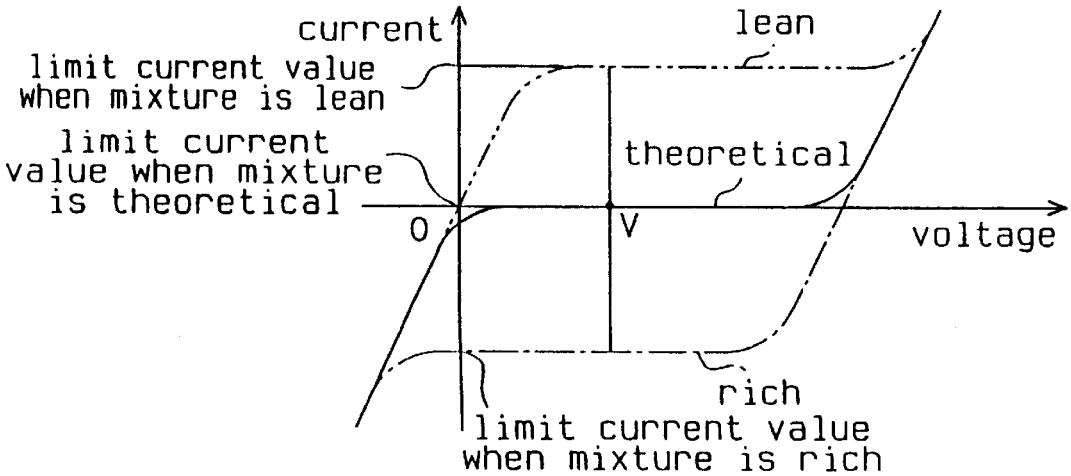
Fig.6 (Prior Art)
FIG. 6 is a graph showing the relationship between limit current value and voltage applied to a prior art air-fuel ratio sensor.

FIG. 5 is a flowchart showing the malfunction detecting routine according to the second embodiment. In steps having the same numerals as those in FIG. 4, the CPU 41 performs the same processes as in the first embodiment.

After finishing the processes of steps 100 to 104, the CPU 41 moves to step 201. In step 201, the CPU 41 judges whether the current value I is greater than the second determination current value Ie2 stored in the memory 42.

The second determination current value Ie2 in the flowchart of FIG. 5 is a determination value for determining whether the sensor 30 has deteriorated. The outer surface of the element 32 is exposed to exhaust gas. Substances in exhaust gas such as lead deteriorate the outer electrode 36. If the element 32 has deteriorated, the current value I becomes lower (as illustrated by a dashed line in FIG. 3) than the normal current value I illustrated by the continuous line.

In the routine of the flowchart of FIG. 5, the CPU 41 determines that the sensor 30 has deteriorated when the current value I becomes equal to or lower than the second determination current value Ie 2. That is, if the determination condition of step 201 is not satisfied (IS≦Ie 2), the CPU 41 moves to step 202. In step 202, the CPU 41 blinks the alarm lamp 50, thereby notifying the driver of deterioration of the sensor 30 and sets a deterioration determination flag to a state indicating such.

If the determination condition is satisfied in step 201 (I>Ie 2), or the process of step 202 is finished, the CPU 41 temporarily suspends the current routine and restarts this routine after a predetermined interval.

The effects and advantages of the second embodiment will be explained.

In addition to the effects and advantages of the first embodiment, deterioration of the air-fuel ratio sensor 30 is detected by comparing the current value I in the sensor 30 with the second determination value Ie2. Therefore, the routine of FIG. 5 detects malfunctions of the sensor 30 more accurately.

Although two embodiments of the present invention have been described herein, it should be apparent to those skilled in the art that the present invention may be embodied in many other specific forms without departing from the spirit or scope of the invention, particularly, it should be understood that the invention may be embodied in the following forms.

In the above embodiment, the second determination voltage Ve is positive (1.2V). However the voltage Ve may be a negative voltage (for example, −0.5V) that is lower than the lower limit value in the limit voltage region.

The actual air-fuel ratio of the engine 11, which is detected by the air-fuel ratio sensor 30, is feedback controlled to be equal to a target air-fuel ratio. However, when the malfunction determination flag or the deterioration determination flag indicates that there Is a malfunction or a deterioration, the feedback control may be changed to an open-loop control. This prevents the air-fuel ratio control from being operated based on wrongly detected signal from the sensor 30.

Therefore, the present examples and embodiments are to be considered as illustrative and not restrictive and the invention is not to be limited to the details given herein, but may be modified within the scope and equivalence of the appended claims.

What is claimed is:

1. An apparatus for detecting malfunction of an air-fuel ratio sensor employed in an exhaust passage of an internal combustion engine, wherein a current output value of said sensor varies in accordance with a voltage applied to the sensor and with the concentration of oxygen in exhaust gas within the exhaust passage, and wherein said sensor has a certain applied voltage range in which said output current value is substantially zero when the air-fuel ratio of said mixture substantially matches a theoretical optimum air-fuel ratio, wherein the engine includes:

a combustion chamber;

an intake passage for introducing air-fuel mixture to the combustion chamber; and a fuel controller for controlling the amount of fuel in said mixture in accordance with the magnitude of said output current value when a first predetermined voltage is applied to said sensor such that the air-fuel ratio of said mixture is made to substantially coincide with a target air-fuel ratio, said apparatus comprising:

a voltage changer for changing said applied voltage to a second voltage located outside of said certain applied voltage range; and a malfunction detector for detecting malfunctions in said sensor after said applied voltage is changed to said second voltage.

2. The apparatus according to claim 1, wherein said malfunction detector compares said output current value with a reference current value and detects malfunctions in said sensor based on the results of said comparison.

3. The apparatus according to claim 2, wherein application of the second voltage causes said output current value to be greater than zero, and said malfunction detector detects malfunctions of said sensor when said output current value is lower than said reference current value.

4. The apparatus according to claim 3, wherein two reference current values are provided, and wherein a first reference current value is approximately zero and a second reference current value is greater than the first reference value, wherein said malfunction detector comprises:

a first determiner for comparing said output current value with said first reference current value;

a second determiner for comparing said output current value with said second reference current value; and a malfunction identifier for judging the degree of a malfunction of said sensor based on the determinations of said first determiner and said second determiner.

5. The apparatus according to claim 4 further comprising a warning device for warning an operator of malfunctions of said sensor, wherein a different warning is issued depending on the degree of a malfunction as identified by the identifier.

6. The apparatus according to claim 1, further comprising a warning device for warning an operator of malfunctions of said sensor.

7. The apparatus according to claim 1, wherein said voltage changer changes said applied voltage to a voltage that is greater than the upper limit value of said certian applied voltage range.

8. The apparatus according to claim 1, further comprising:

an estimator for estimating the temperature of said sensor; and an activation determiner for determining whether said sensor is activated based on said estimated temperature of said sensor, wherein detection of malfunctions in said sensor by said malfunction detector is prohibited when said activation determiner determines that said sensor is not activated.

9. The apparatus according to claim 8, wherein said activation determiner determines that said sensor is not activated when the temperature of said sensor is equal to or lower than a reference temperature.

10. The apparatus according to claim 8, wherein said estimator estimates the temperature of said sensor based on the temperature of said internal combustion engine.

11. An apparatus for detecting malfunction of an air-fuel ratio sensor employed in an exhaust passage of an internal combustion engine, wherein a current output value of said sensor varies in accordance with a voltage applied to the sensor and with the concentration of oxygen in exhaust gas within the exhaust passage, and wherein said sensor has a certian applied voltage range in which said output current value is substantially zero when the air-fuel ratio of said mixture substantially matches a theoretical optimum air-fuel ratio, wherein the engine includes:

a combustion chamber;

an intake passage for introducing air-fuel mixture to the combustion chamber; and a fuel controller for controlling the amount of fuel in said mixture in accordance with the magnitude of said output current value when a first predetermined voltage is applied to said sensor such that the air-fuel ratio of said mixture is made to substantially coincide with a target air-fuel ratio, said apparatus comprising:

a voltage changer for changing said applied voltage to a second voltage located outside of said certian applied voltage range; and a malfunction detector for detecting malfunctions in said sensor after said applied voltage is changed to said second voltage, wherein said malfunction detector compares said output current value with a reference current value and detects malfunctions in said sensor based on the results of said comparison.

12. The apparatus according to claim 11, wherein the malfunction detector further includes a malfunction identifier that estimates the degree of the malfunction if a malfunction is detected by estimating a range in which the sensor output current value falls.

* * * * *